US007442134B2

(12) United States Patent
Giannetti et al.

(10) Patent No.: US 7,442,134 B2
(45) Date of Patent: Oct. 28, 2008

(54) BALL BAT INCLUDING AN INTEGRAL SHOCK ATTENUATION REGION

(75) Inventors: William B. Giannetti, Winnetka, CA (US); Dewey Chauvin, Simi Valley, CA (US); Enemecio Hernandez, Van Nuys, CA (US)

(73) Assignee: Easton Sports, Inc., Van Nuys, CA (US)

( * ) Notice: Subject to any disclaimer, the term of this patent is extended or adjusted under 35 U.S.C. 154(b) by 0 days.

(21) Appl. No.: 11/078,782

(22) Filed: Mar. 11, 2005

(65) Prior Publication Data

US 2006/0025251 A1 Feb. 2, 2006

Related U.S. Application Data

(63) Continuation-in-part of application No. 10/903,493, filed on Jul. 29, 2004, now Pat. No. 7,115,054.

(51) Int. Cl.
*A63B 59/06* (2006.01)

(52) U.S. Cl. ..... 473/567

(58) Field of Classification Search ..... 473/564–568, 473/457, 519, 520
See application file for complete search history.

(56) References Cited

U.S. PATENT DOCUMENTS

| | | | | |
|---|---|---|---|---|
| 1,611,858 | A | 12/1926 | Middlekauff | |
| 4,848,745 | A * | 7/1989 | Bohannan et al. | 473/119 |
| 4,931,247 | A | 6/1990 | Yeh | |
| 5,131,651 | A * | 7/1992 | You | 473/520 |
| 5,301,940 | A | 4/1994 | Seki et al. | |
| 5,303,917 | A | 4/1994 | Uke | |
| 5,362,046 | A | 11/1994 | Sims | |
| 5,364,095 | A | 11/1994 | Easton et al. | |
| 5,380,003 | A | 1/1995 | Lanctot | |
| 5,395,108 | A | 3/1995 | Souders et al. | |
| 5,415,398 | A | 5/1995 | Eggiman | |
| 5,511,777 | A | 4/1996 | McNeely | |
| 5,516,097 | A | 5/1996 | Huddleston | |
| 5,593,158 | A | 1/1997 | Filice et al. | |
| 5,624,115 | A | 4/1997 | Baum | |
| 5,676,610 | A | 10/1997 | Bhatt et al. | |
| 5,711,728 | A | 1/1998 | Marcelo | |
| 5,759,113 | A | 6/1998 | Lai et al. | |
| 5,772,541 | A | 6/1998 | Buiatti | |
| 5,833,561 | A | 11/1998 | Kennedy et al. | |
| 5,899,823 | A | 5/1999 | Eggiman | |
| 5,964,673 | A | 10/1999 | MacKay, Jr. | |

(Continued)

OTHER PUBLICATIONS

Mustone, et al., "Using LS-DYNA to Develop a Baseball Bat Performance and Design Tool," 6th International LS-DYNA Users Conference, Apr. 9-10, Detroit, MI.

(Continued)

*Primary Examiner*—Mark S Graham
(74) *Attorney, Agent, or Firm*—Perkins Coie LLP

(57) ABSTRACT

A ball bat includes multiple layers of one or more composite materials. One or more "integral shock attenuation" ("ISA") regions, which have a substantially lower axial stiffness than neighboring regions in the bat, are provided to attenuate shock waves resulting from an "off-center" hit. ISA regions may be incorporated into the transition region, the handle, and/or the barrel of the ball bat to provide vibration damping, shock attenuation, stiffness control, increased flexure, and/or improved feel.

14 Claims, 3 Drawing Sheets

U.S. PATENT DOCUMENTS

| | | | | |
|---|---|---|---|---|
| 6,007,439 | A | 12/1999 | MacKay, Jr. | |
| 6,042,493 | A | 3/2000 | Chauvin et al. | |
| 6,053,828 | A | 4/2000 | Pitsenberger | |
| 6,344,007 | B1 | 2/2002 | Feeney et al. | |
| 6,352,485 | B1 | 3/2002 | Philpot et al. | |
| 6,383,101 | B2 | 5/2002 | Eggiman et al. | |
| 6,398,675 | B1 | 6/2002 | Eggiman et al. | |
| 6,425,836 | B1 | 7/2002 | Misono et al. | |
| 6,440,017 | B1 | 8/2002 | Anderson | |
| 6,461,260 | B1 | 10/2002 | Higginbotham | |
| 6,497,631 | B1 | 12/2002 | Fritzke et al. | |
| 6,508,731 | B1 | 1/2003 | Feeney et al. | |
| 6,663,517 | B2 | 12/2003 | Buiatti et al. | |
| 6,729,983 | B1 | 5/2004 | Vakili et al. | |
| 6,764,419 | B1 | 7/2004 | Giannetti et al. | |
| 6,776,735 | B1 | 8/2004 | Belanger et al. | |
| 6,863,628 | B1 | 3/2005 | Brandt | |
| 2001/0014634 | A1 | 8/2001 | MacKay, III | |
| 2002/0151392 | A1 | 10/2002 | Buiatti et al. | |
| 2002/0198071 | A1* | 12/2002 | Snow | 473/564 |
| 2003/0186763 | A1* | 10/2003 | Eggiman et al. | 473/564 |
| 2003/0195066 | A1* | 10/2003 | Eggiman et al. | 473/567 |
| 2004/0077439 | A1* | 4/2004 | Eggiman et al. | 473/567 |
| 2004/0176197 | A1 | 9/2004 | Sutherland | |
| 2005/0070384 | A1* | 3/2005 | Fitzgerald et al. | 473/567 |
| 2005/0143203 | A1* | 6/2005 | Souders et al. | 473/564 |
| 2005/0227795 | A1 | 10/2005 | Fritzke | |

OTHER PUBLICATIONS

Combined International Search Report and Written Opinion of the International Searching Authority for International Application No. PCT/US05/26872; issued by the ISA/US;dated Dec. 5, 2005.

* cited by examiner

| Ply Orientation (from longitudinal axis) | Young's Modulus (Msi) Graphite Ex (axial) | Graphite Ey (radial) | S-glass Ex (axial) | S-glass Ey (radial) |
|---|---|---|---|---|
| 0 | 19.66 | 1.34 | 6.91 | 1.93 |
| 5 | 17.67 | 1.35 | 6.61 | 1.92 |
| 10 | 13.95 | 1.37 | 5.87 | 1.90 |
| 15 | 10.70 | 1.40 | 5.01 | 1.86 |
| 20 | 8.28 | 1.47 | 4.21 | 1.83 |
| 25 | 6.47 | 1.56 | 3.53 | 1.80 |
| 30 | 5.08 | 1.70 | 3.00 | 1.79 |
| 35 | 4.02 | 1.91 | 2.56 | 1.82 |
| 40 | 3.21 | 2.20 | 2.25 | 1.89 |
| 45 | 2.63 | 2.63 | 2.03 | 2.03 |
| 50 | 2.20 | 3.21 | 1.89 | 2.25 |
| 55 | 1.91 | 4.02 | 1.82 | 2.56 |
| 60 | 1.70 | 5.08 | 1.79 | 3.00 |
| 65 | 1.56 | 6.47 | 1.80 | 3.53 |
| 70 | 1.47 | 8.28 | 1.83 | 4.21 |
| 75 | 1.40 | 10.70 | 1.86 | 5.01 |
| 80 | 1.37 | 13.95 | 1.90 | 5.87 |
| 85 | 1.35 | 17.67 | 1.92 | 6.61 |
| 90 | 1.34 | 19.66 | 1.93 | 6.91 |

BALL BAT INCLUDING AN INTEGRAL SHOCK ATTENUATION REGION

This application is a Continuation-In-Part of U.S. patent application Ser. No. 10/903,493, filed Jul. 29, 2004, now U.S. Pat. No. 7,115,054, which is incorporated herein by reference.

BACKGROUND

When a baseball bat or softball bat impacts a ball, energy is transferred from the ball to the bat, in the form of deformation (radial and transverse), noise, and heat. When the ball strikes a location of the bat that is in the proximity of a primary vibration node, and/or at the intersection of a primary vibration node and the center of percussion (COP) of the bat, the bat experiences little or no vibration. This is known as a "sweet spot" hit. Alternatively, when the ball strikes a location of the bat that is not in the vicinity of a primary vibration node or the COP, the bat deforms into its fundamental and harmonic mode shapes. The magnitude of this deformation is a direct function of the mode that is excited and the distance from the vibration node to the impact location. If the acceleration of the bat into this mode shape is significantly high, the bat will vibrate and produce shock waves.

Shock waves travel at a very high velocity and, depending upon their energy, can actually sting a player's hands. This event is the direct result of the feedback that a player receives when hitting the ball at a location away from the "sweet spot" of the bat. This is also known as an "off-center hit," because the "sweet spot" of a bat barrel is typically located at approximately the center of its length. The sting resulting from off-center hits may be distracting and painful to the player, and is therefore undesirable. To minimize sting, and improve the "feel" of the bat, shock waves resulting from off-center hits must be attenuated or absorbed prior to reaching the bat's handle.

SUMMARY OF THE INVENTION

A ball bat includes multiple layers of one or more composite materials. One or more integral shock attenuation ("ISA") regions, which have a significantly lower axial stiffness than one or more neighboring regions in the bat, are provided to attenuate shock waves resulting from an "off-center" hit. The shock waves are absorbed or attenuated when they enter the ISA region(s). ISA regions may be incorporated into the transition region, the handle, and/or the barrel of the ball bat to provide vibration damping, shock attenuation, stiffness control, increased flexure, and/or improved feel.

In one aspect, a ball bat includes a barrel including a first material, a handle including a second material, and a transition section joining the barrel to the handle. At least a portion of the transition section includes a third material having a lower axial stiffness than the first and second materials.

In another aspect, the third material extends into at least a portion of the handle of the ball bat.

In another aspect, a fourth material is embedded within the third material. The fourth material includes at least one of an elastomeric rubber, an elastomeric urethane, and an elastomeric foam.

In another aspect, the barrel further includes a fourth material adjacent to a closed end of the barrel, with the fourth material having a lower axial stiffness than the first material.

In another aspect, the third material has an axial Young's modulus that is 30-70% of the axial Young's modulus of at least one of the first and second materials.

In another aspect, the third material has an axial Young's modulus that is 40-60% of the axial Young's modulus of at least one of the first and second materials.

In another aspect, the third material has an axial Young's modulus of 4 to 6 msi.

In another aspect, a ball bat includes a first region including a first material, a second region including a second material, and a third region joining the first region to the second region. The third region includes a third material having a lower axial Young's modulus than the first and second materials.

In another aspect, a ball bat includes a barrel, a handle, and a transition section joining the barrel to the handle. A means for attenuating shock waves is located in at least one of the barrel, the handle, and the transition section and has a lower axial stiffness than at least one region of the ball bat adjacent to the means for attenuating shock waves.

Other features and advantages of the invention will appear hereinafter. The features of the invention described above can be used separately or together, or in various combinations of one or more of them. The invention resides as well in subcombinations of the features described.

BRIEF DESCRIPTION OF THE DRAWINGS

In the drawings, wherein the same reference number indicates the same element throughout the several views.

DETAILED DESCRIPTION OF THE DRAWINGS

Figure 1:
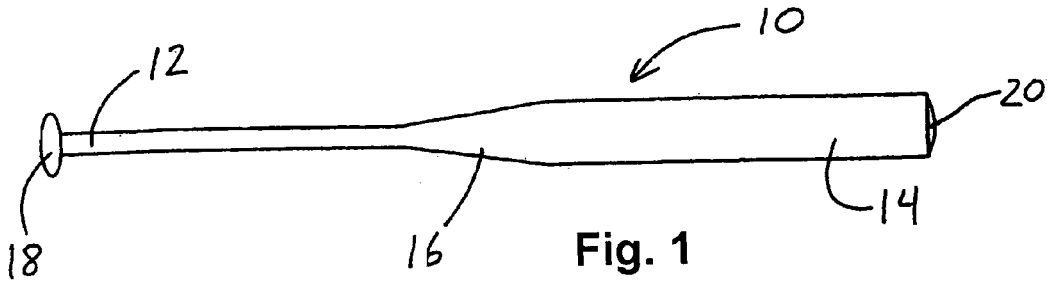
FIG. 1 is a perspective view of a ball bat.

Turning now in detail to the drawings, as shown in FIG. 1, a baseball or softball bat 10, hereinafter collectively referred to as a "ball bat" or "bat," includes a handle 12, a barrel 14, and a transition region or tapered section 16 joining the handle 12 to the barrel 14. The free end of the handle 12 includes a knob 18 or similar structure. The barrel 14 is preferably closed off by a suitable cap, plug, or other end closure 20. The interior of the bat 10 is preferably hollow, which facilitates the bat 10 being relatively lightweight so that ball players may generate substantial bat speed when swinging the bat 10.

The ball bat 10 preferably has an overall length of 20 to 40 inches, more preferably 26 to 34 inches. The overall barrel diameter is preferably 2.0 to 3.0 inches, more preferably 2.25 to 2.75 inches. Typical bats have diameters of 2.25, 2.625, or 2.75 inches. Bats having various combinations of these overall lengths and barrel diameters, as well as any other suitable dimensions, are contemplated herein. The specific preferred combination of bat dimensions is generally dictated by the user of the bat 10, and may vary greatly between users.

The bat barrel 14 may be a single-wall or a multi-wall structure. If it is a multi-wall structure, the barrel walls may be separated by one or more interface shear control zones (ISCZs), as described in detail in incorporated U.S. patent application Ser. No. 10/903,493. Any ISCZ used preferably has a radial thickness of approximately 0.001 to 0.010 inches, more preferably 0.005 to 0.006 inches. Any other suitable size ISCZ may alternatively be used.

An ISCZ may include a bond-inhibiting layer, a friction joint, a sliding joint, an elastomeric joint, an interface between two dissimilar materials (e.g., aluminum and a composite material), or any other suitable means for separating the barrel into "multiple walls." If a bond-inhibiting layer is used, it is preferably made of a fluoropolymer material, such as Teflon® (polyfluoroethylene), FEP (fluorinated ethylene propylene), ETFE (ethylene tetrafluoroethylene), PCTFE (polychlorotrifluoroethylene), or PVF (polyvinyl fluoride), and/or another suitable material, such as PMP (polymethylpentene), nylon (polyamide), or cellophane.

In one embodiment, one or more ISCZs may be integral with, or embedded within, layers of barrel material, such that the barrel 14 acts as a one-piece/multi-wall construction. In such a case, the barrel layers at at least one end of the barrel are preferably blended together to form the one-piece/multi-wall construction. The entire ball bat 10 may also be formed as "one piece." A one-piece bat design generally refers to the barrel 14, the tapered section 16, and the handle 12 of the bat 10 having no gaps, inserts, jackets, or bonded structures that act to appreciably thicken the barrel wall(s). The distinct laminate layers are preferably integral to the barrel structure so that they all act in unison under loading conditions. To accomplish this one-piece design, the layers of the bat 10 are preferably co-cured, and are therefore not made up of a series of connected tubes (inserts or jackets) that each have a separate wall thickness at the ends of the tubes.

The blending of the barrel walls into a one-piece construction, around one or more ISCZs, like tying the ends of a leaf spring together, offers a stable, durable assembly, especially for when impact occurs at the extreme ends of the barrel 14. Bringing multiple laminate layers together assures that the system acts as a unitized structure, with no one layer working independent of the others. By redistributing stresses to the extreme ends of the barrel, local stresses are reduced, resulting in increased bat durability.

The one or more barrel walls preferably each include one or more composite plies. The composite materials that make up the plies are preferably fiber-reinforced, and may include fibers of glass, graphite, boron, carbon, aramid (e.g., Kevlar®), ceramic, metallic, and/or any other suitable structural fibrous materials, preferably in epoxy form or another suitable form. Each composite ply preferably has a thickness of approximately 0.002 to 0.060 inches, more preferably 0.005 to 0.008 inches. Any other suitable ply thickness may alternatively be used.

In one embodiment, the bat barrel 14 may comprise a hybrid metallic-composite structure. For example, the barrel may include one or more walls made of composite material (s), and one or more walls made of metallic material(s). Alternatively, composite and metallic materials may be interspersed within a given barrel wall. In another embodiment, nano-tubes, such as high-strength carbon nano-tube composite structures, may alternatively or additionally be used in the barrel construction.

Figure 2:
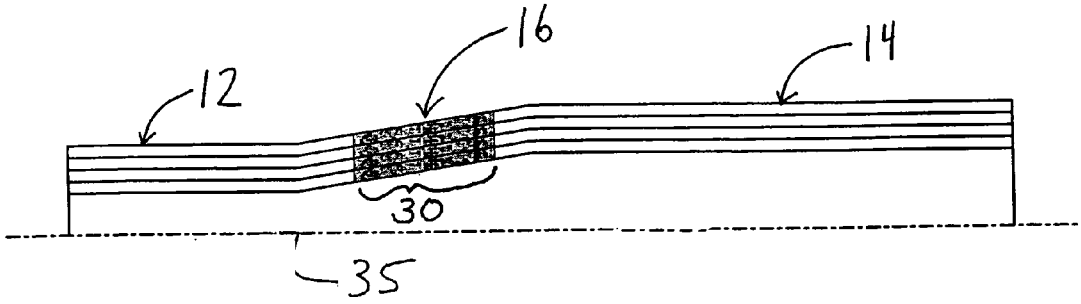
FIG. 2 is a partial side-sectional view of a ball bat including an ISA region located in the tapered section of the ball bat.

Referring to FIG. 2, an integral shock attenuation ("ISA") region 30 is located in the transition region or tapered section 16 of the ball bat 10. The ISA region 30 (as well as the other ISA region embodiments described below) includes one or more high damping and/or low modulus materials, which are effective at dissipating or attenuating vibrational energy from shock waves entering the ISA region 30. The one or more materials that make up the ISA region 30 preferably have a substantially lower longitudinal or axial Young's modulus than the adjacent material(s) located longitudinally above and/or below the ISA region 30 in the bat construction. As a result, assuming a relatively uniform sectional thickness, the ISA region 30 has a lower axial stiffness (structural axial stiffness=axial Young's modulus*cross-sectional modulus of the material) than the material(s) located longitudinally above and/or below the ISA region 30 (i.e., the barrel 14 and handle 12 materials in FIG. 2).

The ISA region 30 is preferably made of one or more materials having an axial Young's modulus that is 15-85%, or 30-70%, or 40-60%, or 50% of the axial Young's modulus of the adjacent material(s) located longitudinally above and/or below the ISA region 30 in the bat construction. The ISA region 30 may, for example, be made of a material having an axial Young's modulus of approximately 3 to 7 msi, or 4 to 6 msi, while the adjacent regions of the bat construction may have an axial Young's modulus of approximately 8 to 12 msi, or 10 msi.

Figures 5, 6:
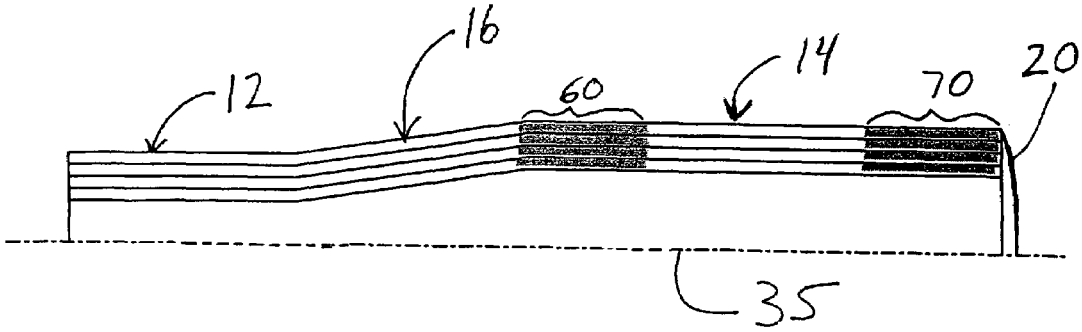
FIG. 5 is a partial side-sectional view of a ball bat including multiple ISA regions located in the barrel of the ball bat.
FIG. 6 is a table displaying the axial and radial Young's moduli of a ply of graphite and a ply of s-glass when oriented at various angles relative to the longitudinal axis of a ball bat.

As shown in the table of FIG. 6, the axial Young's modulus of a given ply of material (graphite and s-glass, a type of fiberglass, are shown in the table by way of example only) varies with its orientation relative to a longitudinal axis 35 of the ball bat 10. Accordingly, the specific material(s) selected for the ISA region 30 may vary depending on the orientation of the material layers within the bat structure. To meet the parameters outlined in the example above, for example, the ISA region 30 may include one or more composite layers or plies including reinforcement fibers of s-glass, with substantially each ply oriented at an angle of 10° to 20° from a longitudinal axis of the ball bat (such that the axial Young modulus of each ply is approximately 4.21 to 5.87 msi). Similarly, the ISA region 30 may include one or more composite layers or plies including reinforcement fibers of graphite, with substantially each ply oriented at an angle of 25° to 35° from a longitudinal axis of the ball bat (such that the axial Young modulus of each ply is approximately 4.02 to 6.47 msi).

Other possible ISA region materials include, but are not limited to, composite layers or plies including reinforcement fibers of aramid (e.g., Kevlar®, Spectra®, and the like), PBO (Zylon®), UHMWPE (Ultra High Molecular Weight Polyethylene), and/or any other suitable material having a relatively low axial Young's modulus at various ply orientations and/or otherwise having high damping characteristics. Viscoelastic materials, such as elastomeric rubbers, may also be used in the ISA region 30. The ISA region 30 preferably further includes reinforcement resins, such as thermoset, thermoplastic, and/or infused resins, or any other suitable resins.

By placing the ISA region 30 in the transition region or tapered section 16 of the ball bat 10, vibrational energy can be attenuated in the bat structure without affecting barrel performance kinetics. The low modulus, high damping ISA layers act as a dissipation barrier to shock waves, resulting from an off-center hit, that travel from the barrel 14 toward the handle 12 of the ball bat 10. The ISA region 30 attenuates, or absorbs, the shock waves, thus substantially or completely preventing the shock waves from reaching the bat handle 12 and the batter's hands. As a result, sting is substantially reduced or eliminated.

Figure 3:
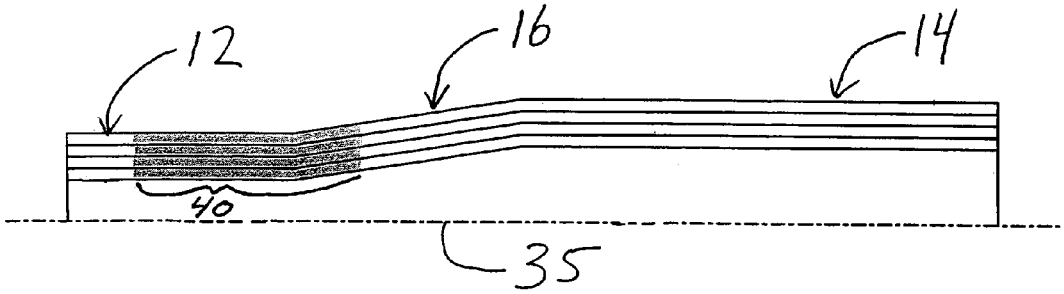
FIG. 3 is a partial side-sectional view of a ball bat including an ISA region located in the handle, and extending into the tapered section, of the ball bat.

Referring to FIG. 3, in another embodiment, an ISA region 40 is located in the region of the ball bat 10 where the handle 12 merges into the tapered section 16, such that the ISA region 40 resides in both the handle 12 and the tapered section 16 of the ball bat 10. Positioning the ISA region 40 in this section is advantageous due to its relatively low cross-sectional modulus, which contributes to a relatively low axial stiffness of the section, thereby facilitating vibrational movement of the ISA region 40 to dissipate energy of shock waves entering the ISA region 40.

Figure 4:
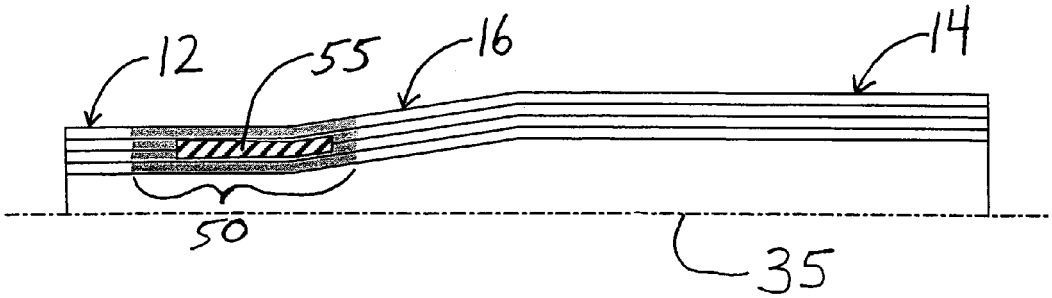
FIG. 4 is a partial side-sectional view of a ball bat including a sandwich construction ISA region located in the handle, and extending into the tapered section, of the ball bat.

Referring to FIG. 4, in another embodiment, an ISA region 50 is formed as a sandwich construction including an insert 55, which is made of one or more highly damping materials, surrounded by one or more plies of fiber-reinforced composite material(s). The insert 55 is preferably a viscoelastic or elastomeric rubber, urethane, and/or foam material, or any other material that effectively dampens vibrational energy. Including such an insert 55 in the ISA region 50 can increase the efficiency and durability of the ISA region 50, especially in cases where the surrounding ISA region fibers have low compressive strength and/or poor strain energy recovery. The sandwich ISA region 50 may be located in the handle 12, the tapered section 16, and/or any other suitable region of the bat construction. In FIG. 4, the sandwich ISA region 50 is shown located in the region of the ball bat 10 where the handle 12 merges into the tapered section 16 by way of example only.

Referring to FIG. 5, in another embodiment, two (or more) ISA regions 60, 70 may be used to isolate the hitting portion of the bat barrel 14 from the handle 12 and end closure 20 of the ball bat 10. The end closure 20 of a ball bat 10 is typically stiffer than the adjacent barrel section so that the end closure 20 can provide sufficient durability to the open end of the bat barrel 14. Forging the end of the bat barrel, rolling over the rim of the barrel to form a full or nearly full closure, and/or filling the barrel with a urethane or similar semi-rigid material are typical methods used for stiffening the end of the bat barrel 14.

The stiffening of the end closure 20, however, may increase the vibrational response of the ball bat 10, while not allowing for sufficient barrel movement to effectively dissipate vibrational energy. By locating a first ISA region 70 adjacent to the end closure 20 of the bat 10, and a second ISA region 60 at or adjacent to the tapered section 16 (or the handle 12) of the bat 10, vibration induced at the hitting portion of the bat 10 is isolated from both the handle 12 and the end closure 20, such that little or no vibrational energy travels to the bat handle 12 (and the batter's hands), or to the relatively stiff end closure 20. As a result, sting is substantially reduced or eliminated.

In any of the embodiments described above, the ISA region (s) employed may occupy the entire radial thickness (as shown in FIGS. 2-5, for example), or only a portion of the radial thickness, of the barrel wall in a single-wall barrel design. In a multi-wall barrel design, an ISA region may be included in only one of the barrel walls, or in two or more of the barrel walls. Additionally, any ISA region used in a multi-wall barrel may occupy all or a portion of the radial barrel thickness of one or more of the barrel walls. While shock waves will generally be better attenuated when the one or more ISA regions occupy the entire radial barrel thickness, any suitable portion of the radial barrel thickness may be occupied by the one or more ISA regions.

The ball bat 10 may be constructed in any suitable manner. In one embodiment, the ball bat 10 is constructed by rolling the various layers of the bat 10 onto a mandrel or similar structure having the desired bat shape. The one or more ISA regions, as well as any ISCZs, if used, are preferably strategically placed, located, and/or oriented, as shown and described above. The one or more ISA regions may be located in the tapered section 16, the handle 12, and/or the barrel 14 of the ball bat 10 to provide attenuation of vibrational energy in those regions.

The structural layer orientations of the one or more ISA regions may be varied to achieve a desired level of vibration attenuation. The table of FIG. 6 illustrates how the axial Young's modulus of a given ply of material (graphite and s-glass are shown as examples), and thus, the ply's axial stiffness, may be modified by varying the orientation of the ply relative to the longitudinal axis of the ball bat 10. By varying one or more ISA region plies in this manner, an ISA region can be tailored to meet the needs of a variety of players. For example, the axial stiffness throughout the one or more ISA region(s) in a ball bat 10 may be manipulated to provide more elastic recoil for less skilled players, or less elastic recoil for more skilled players. ISA regions may also be located in specific regions of the ball bat 10 to provide increased flexure in those regions.

The ends of the material layers are preferably "clocked," or offset, from one another so that they do not all terminate at the same location before curing. Additionally, if varying layer orientations and/or wall thicknesses are used, the layers may be staggered, feathered, or otherwise angled or manipulated to form the desired bat shape. Accordingly, when heat and pressure are applied to cure the bat 10, the various layers blend together into a distinctive "one-piece," or integral, construction.

Put another way, all of the layers of the bat are "co-cured" in a single step, and blend or terminate together at at least one end, resulting in a single-piece structure with no gaps (at the at least one end), such that the barrel 14 is not made up of a series of tubes, each with a separate wall thickness that terminates at the ends of the tubes. As a result, all of the layers act in unison under loading conditions, such as during striking of a ball. One or both ends of the barrel 14 may terminate together in this manner to form a one-piece barrel 14, including one or more barrel walls (depending on whether any ISCZs are used). In an alternative design, neither end of the barrel is blended together, such that a multi-piece construction is formed.

The described bat construction, incorporating one or more ISA regions, significantly decreases the vibrational energy transmitted to the bat handle and the batter's hands. Accordingly, sting felt by the batter is significantly reduced or eliminated, and the "sweet spot" of the bat is effectively increased. Additionally, ISA regions may be located in specific regions of the ball bat to provide increased flexure in those regions.

Thus, while several embodiments have been shown and described, various changes and substitutions may of course be made, without departing from the spirit and scope of the invention. The invention, therefore, should not be limited, except by the following claims and their equivalents.

What is claimed is:

1. A ball bat, comprising:

a barrel comprising a first composite material including a first fiber;

a handle comprising a second composite material including a second fiber; and a transition section joining the barrel to the handle, with at least a portion of the transition section comprising a third composite material including a third fiber that is different than the first and second fibers, wherein the third fiber has a lower axial stiffness than that of the first and second fibers, and wherein the portion of the transition section comprising the third composite material has a lower axial stiffness than an axial stiffness of the handle due to the presence of the third fiber;

wherein the barrel further comprises a fourth material, which is the same material as the third material, adjacent to a closed end of the barrel.

2. The ball bat of claim 1 wherein the first and second materials comprise the same material.

3. The ball bat of claim 1 wherein the third material comprises fiberglass.

4. The ball bat of claim 3 wherein the fiberglass material is embodied in a plurality of plies, with at least substantially each of the plies oriented at an angle of 10 to 20 degrees from a longitudinal axis of the ball bat.

5. The ball bat of claim 1 wherein the third material extends into at least a portion of the handle of the ball bat.

6. The ball bat of claim 1 further comprising a fifth material embedded within the third material, wherein the fifth material comprises at least one of an elastomeric rubber, an elastomeric urethane, and an elastomeric foam.

7. The ball bat of claim 1 wherein the third material comprises at least one material selected from the group consisting of graphite, aramid, PBO, and UHMWPE.

8. The ball bat of claim 1 wherein the third material has an axial Young's modulus that is 30 to 70% of the axial Young's modulus of at least one of the first and second materials.

9. The ball bat of claim 1 wherein the third material has an axial Young's modulus that is 40 to 60% of the axial Young's modulus of at least one of the first and second materials.

10. The ball bat of claim 9 wherein the third material has an axial Young's modulus of 4 to 6 msi.

11. A ball bat, comprising:

a first region, comprising a first composite material, having a first axial stiffness;

a second region, comprising a second composite material, having a second axial stiffness; and a third region longitudinally joining the first region to the second region, wherein the third region comprises a third composite material having fibers different than, and having a lower axial Young's modulus than, fibers in the first and second composite materials, and wherein a fourth material comprising at least one of an elastomeric rubber, an elastomeric urethane, and an elastomeric foam is embedded within the third composite material, such that the third region has a third axial stiffness that is lower than the first and second axial stiffnesses.

12. The ball bat of claim 11 wherein the third region is at least partially located in a tapered section of the ball bat.

13. The ball bat of claim 12 wherein the third region is at least partially located in a handle of the ball bat.

14. The ball bat of claim 11 wherein the first and second composite materials comprise the same material.

* * * * *